US008581511B2

(12) United States Patent
Kim et al.

(10) Patent No.: US 8,581,511 B2
(45) Date of Patent: Nov. 12, 2013

(54) CIRCUIT AND METHOD FOR GENERATING PWM SIGNAL FOR DC-DC CONVERTER USING DIMMING SIGNAL AND LED DRIVING CIRCUIT FOR BACKLIGHT HAVING THE SAME

(75) Inventors: Eung-suen Kim, Cheongju-si (KR); Jin-sub Han, Cheongju-si (KR); Seung-beom Baik, Cheongju-si (KR); Chang-sik Lim, Cheongju-si (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 340 days.

(21) Appl. No.: 13/023,580

(22) Filed: Feb. 9, 2011

(65) Prior Publication Data

US 2011/0227502 A1 Sep. 22, 2011

(30) Foreign Application Priority Data

Mar. 18, 2010 (KR) ..... 10-2010-0024485

(51) Int. Cl.
*H05B 37/02* (2006.01)

(52) U.S. Cl.
USPC ..... 315/291; 345/102

(58) Field of Classification Search
USPC ..... 345/82, 102; 315/291, 307, 308, DIG. 4
See application file for complete search history.

(56) References Cited

U.S. PATENT DOCUMENTS

| | | | | |
|---|---|---|---|---|
| 8,154,222 | B2 * | 4/2012 | Korsunsky et al. | 315/308 |
| 2007/0210725 | A1 | 9/2007 | Marosek | |
| 2009/0295776 | A1 * | 12/2009 | Yu et al. | 345/212 |
| 2010/0141633 | A1 * | 6/2010 | Goder | 345/212 |
| 2010/0164858 | A1 * | 7/2010 | Kikuchi | 345/102 |

* cited by examiner

*Primary Examiner* — Thuy Vinh Tran
(74) *Attorney, Agent, or Firm* — NSIP Law

(57) ABSTRACT

A pulse width modulation (PWM) signal generating circuit that generates a PWM signal for a DC-DC converter using a dimming signal is provided. The PWM signal generating circuit includes a normal PWM signal generator configured to generate a normal PWM signal based on a clock signal provided to the DC-DC converter, and a compensation PWM signal generator configured to generate a compensation PWM signal based on the clock signal and the dimming signal.

23 Claims, 4 Drawing Sheets

RELATED ART

CIRCUIT AND METHOD FOR GENERATING PWM SIGNAL FOR DC-DC CONVERTER USING DIMMING SIGNAL AND LED DRIVING CIRCUIT FOR BACKLIGHT HAVING THE SAME

CROSS-REFERENCE TO RELATED APPLICATIONS

This application claims the benefit under 35 U.S.C. §119 (a) of Korean Patent Application No. 10-2010-0024485, filed on Mar. 18, 2010, in the Korean Intellectual Property Office, the entire disclosure of which is incorporated herein by reference for all purposes.

BACKGROUND

1. Field

The following description relates to a light emitting diode (LED) driving circuit for backlight, and more particularly, to a circuit and a method for generating a pulse width modulation (PWM) signal for a DC-DC converter using a dimming signal, and a LED driving circuit for backlight having the same.

2. Description of Related Art

A liquid crystal display (LCD), which is a representative flat panel display apparatus, displays an image using an electric and optical characteristic of liquid crystal. The LCD is being widely used because it has many advantages compared to other display apparatuses, such having a slim thickness, being lightweight, having low power consumption, and having low driving voltage. However, since an LCD panel used in the LCD is a non-emissive element that is unable to emit light by itself, the LCD requires an extra backlight unit in order to supply light to the LCD panel.

A cold cathode fluorescent lamp (CCFL) and a light emitting diode (LED) are used as such an extra backlight unit. Since the backlight unit using the CCFL uses mercury, the backlight unit may cause an environmental pollution problem and have a low speed response. In addition, the backlight unit of the CCFL has the demerits of poor color reproduction and generation of pre-set white light.

On the other hand, the backlight unit using the LED does not use a material harmful to the environment and is capable of achieving a high-speed response and impulsive driving. In addition, the LED backlight unit has the merit of good color reproduction and an ability to adjust color coordinates and brightness of light by adjusting amounts of light of red, blue, and green LEDs. The LED light unit creates white light by mixing red light, blue light, and green light appropriately. Therefore, the LED backlight unit includes a plurality of red LED arrays for emitting red light, a plurality of blue LED arrays for emitting blue light, and a plurality of green LED arrays for emitting green light.

The LED backlight unit adjusts brightness of the LED using a dimming method. Dimming methods include an analog dimming method and a digital dimming method. The analog dimming method adjusts the brightness of the LED by adjusting an amount of electric current supplied to each of the LEDs. In other words, according to the analog dimming method, if the amount of electric current to each LED is reduced by half, the brightness of each LED is reduced by half. A pulse width modulation (PWM) dimming method, which is the digital dimming method, adjusts brightness of the LED by adjusting a ratio of on-off time of each LED according to a PWM signal. For example, if a PWM signal having an on-off time ratio of 4:1 is provided to each LED, brightness of the LED reaches 80% of maximum brightness.

In order to adjust the brightness of the LED in the above-described digital dimming method, a clock signal of a DC-DC converter for supplying power to the LED and a dimming signal for adjusting an amount of electric current in the LED are separately provided. In general, the frequency of the clock signal of the DC-DC converter is relatively long and the frequency of the dimming signal is relatively short, and the clock signal of the DC-DC converter and the dimming signal are not synchronized with each other. As an on-period of the dimming signal becomes shorter, it is more difficult for the DC-DC converter to maintain sufficient output voltage to drive the LED as much as is desired.

FIG. 1 is a view illustrating an example of waveforms to explain an operation of generating a PWM signal based on a dimming signal in the related art. Referring to FIG. 1, "CK" indicates a clock signal of a DC-DC converter. "DM_H" and "DM_L" indicate dimming signals. "DM H" is a dimming signal of a relatively long on-period, and "DM_L" is a dimming signal of a relatively short on-period. "PWM_H" and "PWM_L" indicate PWM signals provided to the DC-DC converter. "PWM_H" is a PWM signal obtained based on the dimming signal (DM_H), and "PWM_L" is a PWM signal obtained based on the dimming signal (DM_L).

In the case of the dimming signal (DM_H) having the long on-period, a plurality of PWM signals (PWM_H) are generated during the on-period and are provided to the DC-DC converter, so that the DC-DC converter maintains stable output voltage. However, in the case of the dimming signal (DM_L) having the short on-period, no PWM signal (PWM_L) is generated during the on-period. In other words, since no PWM signal is generated during one period (1T (DM)) of the dimming signal, the DC-DC converter cannot maintain stable output voltage.

SUMMARY

General aspects are directed to a circuit and a method for generating a PWM signal for a DC-DC converter, which are configured to generate a compensation PWM signal using a dimming signal, thereby allowing the DC-DC converter to maintain stable output, and an LED driving circuit for backlight using the same.

According to one general aspect, a pulse width modulation (PWM) signal generating circuit configured to generate a PWM signal for a DC-DC converter using a dimming signal is provided. The PWM signal generating circuit includes a normal PWM signal generator configured to generate a normal PWM signal based on a clock signal provided to the DC-DC converter, and a compensation PWM signal generator configured to generate a compensation PWM signal based on the clock signal and the dimming signal.

The PWM signal generating circuit may include that the normal PWM signal generator is further configured to generate the normal PWM signal during a first level period of the dimming signal.

The PWM signal generating circuit may include that the first level period of the dimming signal includes a high-level period of the dimming signal.

The PWM signal generating circuit may include that the compensation PWM signal generator is further configured to generate at least one compensation PWM signal during a second level period of the dimming signal.

The PWM signal generating circuit may include that the second level period of the dimming signal includes a low-level period.

The PWM signal generating circuit may include that the compensation PWM signal has a pulse width that is the same as a pulse width of the normal PWM signal.

The PWM signal generating circuit may include that the compensation PWM signal has a pulse width that is the same as a pulse width of the clock signal.

The PWM signal generating circuit may include that the compensation PWM signal generator includes a signal detector configured to detect a low-level period of the dimming signal and generate a detection signal, and a signal generator configured to receive the detection signal from the signal detector and generate the compensation PWM signal.

The PWM signal generating circuit may include that the signal detector includes a flip-flop configured to detect the low-level period of the dimming signal at a rising edge of the clock signal and generate the detection signal.

The PWM signal generating circuit may include that the signal generator includes a flip-flop configured to receive the detection signal from the signal detector and generate the compensation PWM signal.

The PWM signal generating circuit may include that the flip-flop of the signal generator is reset at a negative edge of the clock signal.

The PWM signal generating circuit may include that the compensation PWM signal has a pulse width that is the same as a pulse width of the normal PWM signal.

The PWM signal generating circuit may further include an output unit configured to receive the normal PWM signal from the normal PWM signal generator and the compensation PWM signal from the compensation PWM signal generator, and provide the normal PWM signal and the compensation PWM signal to the DC-DC converter.

The PWM signal generating circuit may include that the output unit comprises an adder configured to add the normal PWM signal received from the normal PWM signal generator and the compensation PWM signal received from the compensation PWM signal generator, and provide an added PWM signal to the DC-DC converter as the PWM signal.

According to another general aspect, a light emitting diode (LED) driving circuit for backlight is provided. The LED driving circuit for backlight includes a PWM signal generator configured to generate a PWM signal using a clock signal and a dimming signal, a DC-DC converter configured to provide an output voltage to an LED of an LED array for backlight, based on the PWM signal generated by the PWM signal generator, and an LED driving unit configured to generate a driving signal for driving the LED using the dimming signal.

The LED driving circuit may include that the PWM signal generator includes a normal PWM signal generator configured to generate a normal PWM signal based on the clock signal during a high-level period of the dimming signal, and a compensation PWM signal generator configured to generate a compensation PWM signal based on the clock signal during a low-level period of the dimming signal.

The LED driving circuit may include that the compensation PWM signal has a pulse width that is the same as a pulse width of the normal PWM signal.

The LED driving circuit may include that the compensation PWM signal has a pulse width that is the same as a pulse width of the clock signal.

The LED driving circuit may include that the compensation PWM signal generator includes a RS flip-flop configured to generate a low-level period of the dimming signal at a rising edge of the clock signal and generate a detection signal, and a D flip-flop configured to generate an output signal at the rising edge of the clock signal based on the detection signal, the D flip-flop being reset at a falling edge of the clock signal to generate the compensation PWM signal.

The LED driving circuit may further include an adder configured to add the normal PWM signal received from the normal PWM signal generator and the compensation PWM signal received from the compensation PWM signal generator, and provide an added PWM signal to the DC-DC converter.

According to another general aspect, a method configured to generate a PWM signal for a DC-DC converter using a dimming signal is provided. The method includes generating a normal PWM signal based on a clock signal during a first period of a dimming signal, providing the normal PWM signal to the DC-DC converter, and generating a compensation PWM signal based on the clock signal during a second period of the dimming signal.

The method may include that the generating of the normal PWM signal includes generating the normal PWM signal during a high-level period of the dimming signal.

The method may include that the generating of the compensation PWM signal includes generating the compensation PWM signal during a low-level period of the dimming signal.

The method may include that the compensation PWM signal has a pulse width that is the same as a pulse width of the normal PWM signal.

Other features and aspects may be apparent from the following the detailed description, the drawings, and the claims.

DETAILED DESCRIPTION

Hereinafter, general aspects are described in detail with reference to the accompanying drawings.

Figure 1:
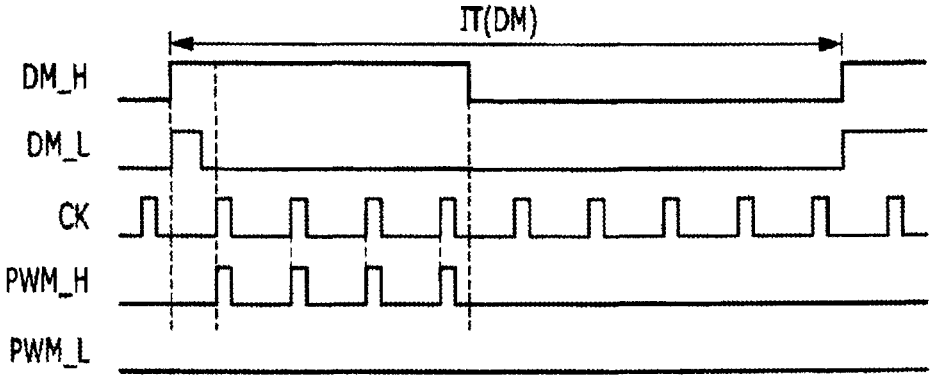
FIG. 1 is a view illustrating an example of waveforms to explain an operation of generating a PWM signal based on a dimming signal in the related art.
Figure 2:
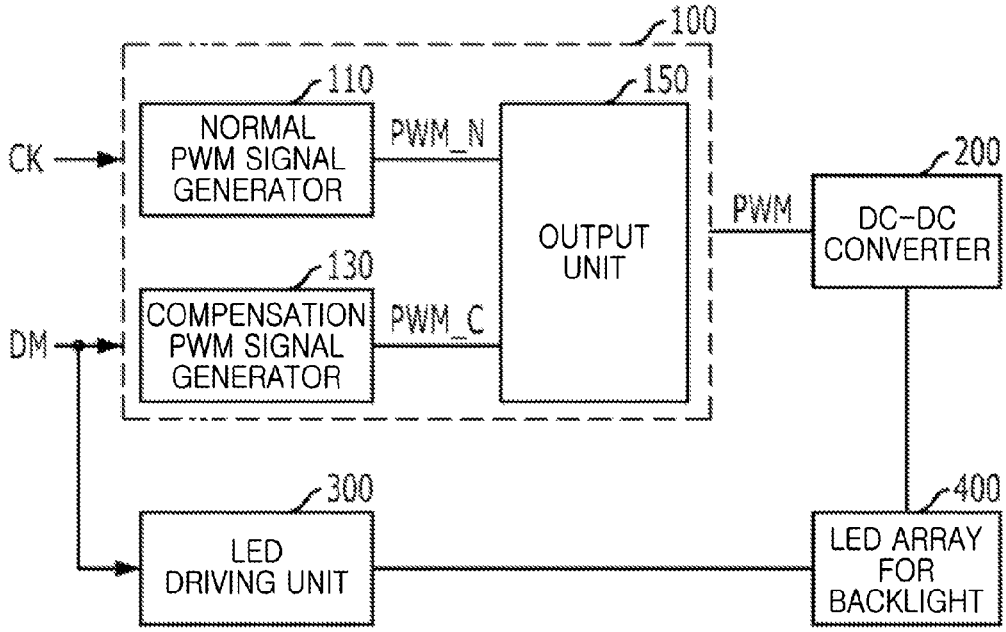
FIG. 2 is a block diagram illustrating an example of an LED driving circuit for backlight.

FIG. 2 is a block diagram illustrating an example of an LED driving circuit for backlight, which uses a dimming signal. Referring to FIG. 2, the LED driving circuit may include a pulse width modulation (PWM) signal generator 100, a DC-DC converter 200, an LED driving unit 300, and an LED array 400.

The PWM signal generator 100 may generate a PWM signal (PWM) by receiving a clock signal (CK) having a relatively short one period (1T (CK)) and a dimming signal (DM) having a relatively long one period (1T (DM)) that is longer than the clock signal (CK). The PWM signal generator may transmit the PWM signal (PWM) to the DC-DC converter 200. The DC-DC converter 200 may receive the PWM signal (PWM) from the PWM signal generator 100 and provide an output voltage that drives an LED (not shown) to the LED array 400 for backlight. The LED driving unit 300 may provide a driving signal that adjusts a brightness of the LED to the LED array 400 using the dimming signal (DM).

The PWM signal generator 100 may include a normal PWM signal generator 110 configured to generate a normal PWM signal (PWM_N) during an on-period of the dimming signal (high-level period) based on the clock signal (CK) and the dimming signal (DM). In addition, the PWM signal generator 100 may include a compensation PWM signal generator 130 configured to generate at least one compensation PWM signal (PWM_C) during an off-period (low-level period) of the dimming signal based on the clock signal (CK) and the dimming signal (DM). The normal PWM signal generator 110 may have the same configuration as that of a general PWM signal generator for a DC-DC converter.

The PWM signal generator 100 may further include an output unit 150 configured to receive the normal PWM signal (PWM_N) generated by the normal PWM signal generator 110 and the compensation PWM signal (PWM_C) generated by the compensation PWM signal generator 130, and provide a PWM signal (PWM) to the DC-DC converter 200. The output unit 150 may further include an adder configured to add the normal PWM signal (PWM_N) and the compensation PWM signal (PWM_C) and provide the PWM signal (PWM) to the DC-DC converter 200.

Figure 4:
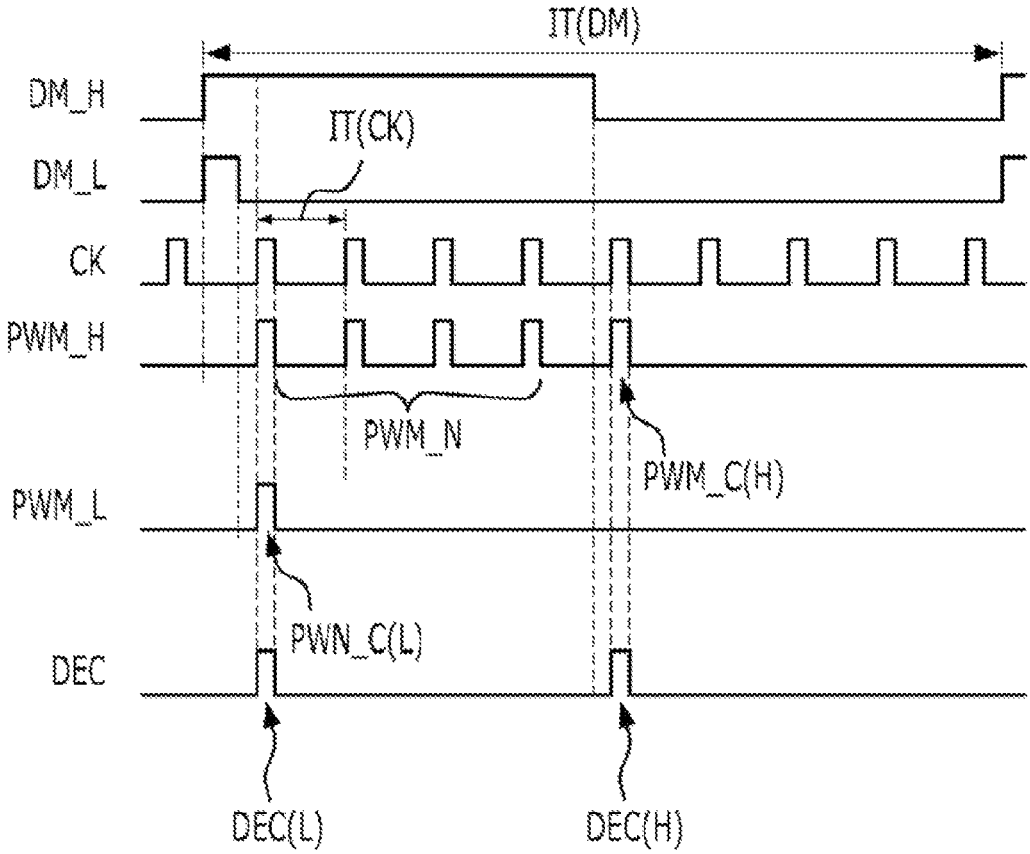
FIG. 4 is a view illustrating an example of waveforms to explain an operation of generating a PWM signal based on a dimming signal.

An example of an operation of the PWM signal generator 100 will be explained below with reference to FIG. 4. Referring to FIG. 4, if a dimming signal having a long on-period (DM_H) is applied, the normal PWM signal generator 110 may generate a normal PWM signal (PWM_N) as a general PWM signal generator for a DC-DC converter. In other words, the normal PWM signal generator 110 may generate the normal PWM signal (PWM_N) based on the clock signal (CK) during the on-period of the dimming signal (DM).

On the other hand, the compensation PWM signal generator 130 may generate a compensation PWM signal (PWM_C) based on the clock signal (CK) during an off-period of the dimming signal (DM). The normal PWM signal (PWM_N) and the compensation PWM signal (PWM_C) may be added to each other by the adder of the output unit 150, thereby generating a PWM signal (PWM_H). The PWM signal (PWM_H) may be provided to the DC-DC converter 200. Accordingly, the DC-DC converter 200 may provide a stable output voltage to the LED of the LED array 400 based on the PWM signal (PWM_H).

The LED driving unit 300 may provide the driving signal for adjusting a brightness of the LED of the LED array 400 using the dimming signal (DM). Accordingly, the LED of the LED array 400 may emit a predetermined amount of light.

Albeit not shown, the LED driving unit 300 may receive a predetermined signal from the compensation PWM signal generator 130 of the PWM signal generator 100, thereby generating the driving signal for the adjusting of the brightness of the LED of the LED array 400.

On the other hand, if a dimming signal having a short on-period (DM_L) is applied, in particular, if a period (1T (DM)) of the dimming signal (DM) is shorter than a period (1T (CK)) of the clock signal (CK), the normal PWM signal generator 110 is not able to generate the normal PWM signal (PWM_N). In other words, the normal PWM signal generator 110 is not able to generate the normal PWM signal (PWM N) based on the clock signal (CK) during the on-period of the dimming signal (DM).

In the related art, since the PWM signal generator 100 provides the PWM signal (PWM) to the DC-DC converter 200 during only the on-period of the dimming signal (DM), the PWM signal generator 100 is not able to provide the PWM signal (PWM) to the DC-DC converter 200, if the dimming signal has the short on-period (DM_L).

However, the compensation PWM signal generator 130 may generate the compensation PWM signal (PWM_C) based on the clock signal (CK) during the off-period of the dimming signal (DM). The output unit 150 may provide the compensation PWM signal (PWM_C) to the DC-DC converter 200 as a PWM signal (PWM_L). Accordingly, since the compensation PWM signal generator 130 may generate at least one compensation PWM signal (PWM_C) even during the off-period of the dimming signal (DM), the DC-DC converter 200 may provide a stable output voltage to the LED of the LED array 400 based on the PWM signal (PWM_L).

Figure 3:
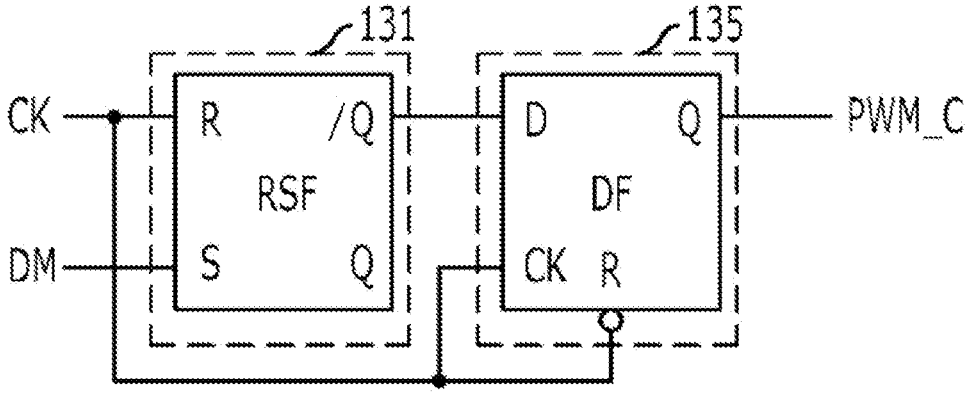
FIG. 3 is a view illustrating an example of a compensation PWM signal generator of FIG. 2.

FIG. 3 is a view illustrating an example of the compensation PWM signal generator 130 of FIG. 2. Referring to FIG. 3, the compensation PWM signal generator 130 may include a signal detector 131 configured to detect the off-period of the dimming signal (DM) based on the clock signal (CK), and a signal generator 135 configured to generate the compensation PWM signal (PWM_C) based on a detection signal (DEC) of the signal detector 131.

The signal detector 131 may include a reset-set (RS) flip-flop (RSF) configured to detect the off-period of the dimming signal at a rising edge of the clock signal (CK), and generate the detection signal (DEC). The signal generator 135 may include a D flip-flop (DF) configured to generate the compensation PWM signal (PWM_C) based on the detection signal (DEC) at the rising edge of the clock signal (CK). The detection signal (DEC) at the rising edge of the clock signal (CK) is a reverse output signal (/Q) of the RS flip-flop (RSF). A reset terminal (R) of the D flip-flop (DF) of the signal generator 135 is provided with the clock signal (CK), but is configured to reset the D flip-flop (DF) at a negative edge of the clock signal (CK).

Referring to FIG. 4, an example of the operation of the compensation PWM signal generator 130 will be explained in detail below.

During the on-period of the dimming signal (DM_H, DM_L), the output signal (Q) and the reverse output signal (/Q) of the RS flip-flop (RSF) are a high level and a low level, respectively, at a falling edge of the clock signal (CK), such that the signal detector 131 does not generate the detection signal. Since the output signal (Q) is the low level at the rising edge of the clock signal (CK), the D flip-flop (DF), which receives the detection signal (DEC) from the signal detector 131 as an input signal, does not allow the signal generator 135 to generate the compensation PWM signal (PWM_C). In other words, since an AND gate (AG) receives the output signal from the D flip-flop (DF) as one input signal, the compensation PWM signal (PWM_C) is not generated.

On the other hand, during the off-period of the dimming signal (DM_H, DM_L), the output signal (Q) and the reverse output signal (/Q) of the RS flip-flop (RSF) are a low level and a high level, respectively, at the rising edge of the clock signal (CK). Further, the output signal (Q) and the reverse output signal (/Q) of the RS flip-flop (RSF) are a high level and a low level, respectively, at the falling edge of the clock signal (CK), such that the detection signal (DEC) having the same on-line period as that of the clock signal (CK) is generated.

In an example, the detection signal (DEC) may have the same on-line period as that of the clock signal (CK).

The D flip-flop (DF), which receives the detection signal (DEC) from the signal detector 131 as an input signal, generates the output signal (Q) of a high level at the rising edge of the clock signal (CK) and is reset at the negative edge of the clock signal (CK) to output the output signal (Q) of a low level. Accordingly, the D flip-flop (DF) generates the compensation PWM signal (PWM_C) having the same period as that of the normal PWM signal (PWM_N) as an output signal through an output terminal.

In other words, the signal generator 135 generates the compensation PWM signal (PWM_C) having the same on-line period as that of the clock signal (CK).

In an example, the compensation PWM signal generator 130 may generate the compensation PWM signal (PWM_C) having the same on-line period as that of the clock signal (CK), thereby generating the compensation PWM signal (PWM_C) having the same on-line period as that of the normal PWM signal (PWM_N). The pulse width of the compensation PWM signal (PWM_C) may be changed by changing the configuration of the signal generator 135.

In addition, in FIG. 4, one compensation PWM signal (PWM_C) may be generated by the compensation PWM signal generator 135. In another example, if a plurality of clock signals (CK) are applied during the off-period within one period (1T (DM)) of the dimming signal (DM), the detection signal (DEC) is generated by the RS flip-flop (RSF) of the signal detector 131 at every rising edge of the clock signal (CK). Therefore, a plurality of compensation PWM signals (PWM_C) may be generated during the off-period of the dimming signal (DM). In addition, one compensation PWM signal (PWM_C) may be generated by changing the configuration of the signal generator 135, as shown in FIG. 4.

While a number of examples have been described above, it will be apparent to those skilled in the art that various changes and modifications may be made and other implementations are within the scope of the following claims.

What is claimed is:

1. A pulse width modulation (PWM) signal generating circuit configured to generate a PWM signal for a DC-DC converter using a dimming signal, the PWM signal generating circuit comprising:

a normal PWM signal generator configured to generate a normal PWM signal based on a clock signal provided to the DC-DC converter; and a compensation PWM signal generator configured to generate a compensation PWM signal based on the clock signal and the dimming signal.

2. The PWM signal generating circuit as claimed in claim 1, wherein the normal PWM signal generator is further configured to generate the normal PWM signal during a first level period of the dimming signal.

3. The PWM signal generating circuit as claimed in claim 2, wherein the first level period of the dimming signal comprises a high-level period of the dimming signal.

4. The PWM signal generating circuit as claimed in claim 1, wherein the compensation PWM signal generator is further configured to generate at least one compensation PWM signal during a second level period of the dimming signal.

5. The PWM signal generating circuit as claimed in claim 4, wherein the second level period of the dimming signal comprises a low-level period.

6. The PWM signal generating circuit as claimed in claim 1, wherein the compensation PWM signal has a pulse width that is the same as a pulse width of the normal PWM signal.

7. The PWM signal generating circuit as claimed in claim 6, wherein the compensation PWM signal has a pulse width that is the same as a pulse width of the clock signal.

8. The PWM signal generating circuit as claimed in claim 1, wherein the compensation PWM signal generator comprises:

a signal detector configured to:

detect a low-level period of the dimming signal; and generate a detection signal; and a signal generator configured to:

receive the detection signal from the signal detector; and generate the compensation PWM signal.

9. The PWM signal generating circuit as claimed in claim 8, wherein the signal detector comprises a flip-flop configured to:

detect the low-level period of the dimming signal at a rising edge of the clock signal; and generate the detection signal.

10. The PWM signal generating circuit as claimed in claim 8, wherein the signal generator comprises a flip-flop configured to:

receive the detection signal from the signal detector; and generate the compensation PWM signal.

11. The PWM signal generating circuit as claimed in claim 10, wherein the flip-flop of the signal generator is reset at a negative edge of the clock signal.

12. The PWM signal generating circuit as claimed in claim 11, wherein the compensation PWM signal has a pulse width that is the same as a pulse width of the normal PWM signal.

13. The PWM signal generating circuit as claimed in claim 1, further comprising:

an output unit configured to:

receive the normal PWM signal from the normal PWM signal generator and the compensation PWM signal from the compensation PWM signal generator; and provide the normal PWM signal and the compensation PWM signal to the DC-DC converter.

14. The PWM signal generating circuit as claimed in claim 13, wherein the output unit comprises an adder configured to:

add the normal PWM signal received from the normal PWM signal generator and the compensation PWM signal received from the compensation PWM signal generator; and provide an added PWM signal to the DC-DC converter as the PWM signal.

15. A light emitting diode (LED) driving circuit for backlight, comprising:

a PWM signal generator configured to generate a PWM signal using a clock signal and a dimming signal;

a DC-DC converter configured to provide an output voltage to an LED of an LED array for backlight, based on the PWM signal generated by the PWM signal generator; and an LED driving unit configured to generate a driving signal for driving the LED using the dimming signal, wherein:

the PWM signal generator comprises:

a normal PWM signal generator configured to generate a normal PWM signal based on the clock signal during a high-level period of the dimming signal; and a compensation PWM signal generator configured to generate a compensation PWM signal based on the clock signal during a low-level period of the dimming signal.

16. The LED driving circuit as claimed in claim 15, wherein the compensation PWM signal has a pulse width that is the same as a pulse width of the normal PWM signal.

17. The LED driving circuit as claimed in claim 16, wherein the compensation PWM signal has a pulse width that is the same as a pulse width of the clock signal.

18. The LED driving circuit as claimed in claim 15, wherein the compensation PWM signal generator comprises:

a RS flip-flop configured to:

generate a low-level period of the dimming signal at a rising edge of the clock signal; and generate a detection signal; and a D flip-flop configured to generate an output signal at the rising edge of the clock signal based on the detection signal, the D flip-flop being reset at a falling edge of the clock signal to generate the compensation PWM signal.

19. The LED driving circuit as claimed in claim 15, further comprising:

an adder configured to:

add the normal PWM signal received from the normal PWM signal generator and the compensation PWM signal received from the compensation PWM signal generator; and provide an added PWM signal to the DC-DC converter.

20. A method configured to generate a PWM signal for a DC-DC converter using a dimming signal, the method comprising:

generating a normal PWM signal based on a clock signal during a first period of a dimming signal;

providing the normal PWM signal to the DC-DC converter; and generating a compensation PWM signal based on the clock signal during a second period of the dimming signal.

21. The method as claimed in claim 20, wherein the generating of the normal PWM signal comprises generating the normal PWM signal during a high-level period of the dimming signal.

22. The method as claimed in claim 20, wherein the generating of the compensation PWM signal comprises generating the compensation PWM signal during a low-level period of the dimming signal.

23. The method as claimed in claim 20, wherein the compensation PWM signal has a pulse width that is the same as a pulse width of the normal PWM signal.

* * * * *